US006328592B1

(12) United States Patent
Burke et al.

(10) Patent No.: US 6,328,592 B1
(45) Date of Patent: Dec. 11, 2001

(54) ELECTRICAL CONNECTOR WITH CABLE CLAMPING MEANS

(75) Inventors: Thomas Francis Burke; Pat White, both of County Clare; Matthew Wilhite, Limerick; Mary O'Halloran, County Clare, all of (IE)

(73) Assignee: Molex Incorporated, Lisle, IL (US)

( * ) Notice: Subject to any disclaimer, the term of this patent is extended or adjusted under 35 U.S.C. 154(b) by 744 days.

(21) Appl. No.: 08/660,482

(22) Filed: Jun. 7, 1996

(51) Int. Cl.[7] ..... H01R 4/24
(52) U.S. Cl. ..... 439/417; 439/404
(58) Field of Search ..... 439/402, 403, 439/404, 405, 417, 418

(56) References Cited

U.S. PATENT DOCUMENTS

| | | | | |
|---|---|---|---|---|
| 4,145,103 | | 3/1979 | Knowles | 339/99 R |
| 4,359,257 | | 11/1982 | Lopinski et al. | 339/99 R |
| 4,410,229 | | 10/1983 | Stephenson | 339/98 |
| 4,475,786 | * | 10/1984 | Root et al. | 439/404 |
| 4,668,039 | | 5/1987 | Marzili | 339/99 R |
| 4,697,862 | | 10/1987 | Hasircoglu | 439/404 |
| 4,938,711 | | 7/1990 | Davis et al. | 439/405 |
| 5,064,383 | * | 11/1991 | Locati et al. | 439/417 |
| 5,171,163 | | 12/1992 | McClelland | 439/404 |
| 5,498,172 | * | 3/1996 | Noda | 439/417 |
| 5,593,314 | * | 1/1997 | Lincoln | 439/418 |
| 5,651,691 | * | 7/1997 | Grumel | 439/417 |

FOREIGN PATENT DOCUMENTS

| | | | |
|---|---|---|---|
| 0358404B1 | 8/1989 | (EP) | H01R/9/07 |
| 0212356B1 | 8/1991 | (EP) | H01R/9/07 |
| 0537790B1 | 10/1992 | (EP) | H01R/9/07 |

* cited by examiner

*Primary Examiner*—Tho D. Ta
(74) *Attorney, Agent, or Firm*—Stephen Z. Weiss

(57) ABSTRACT

An insulation displacement electrical connector assembly is disclosed for electrically terminating the conductors of a multi-conductor insulated flat cable. A connector base has a plurality of terminal-receiving passages. A connector cover is positionable on the base to provide a cable-receiving passage therebetween. The cable-receiving passage traverses the terminal-receiving passages. Complementary interengaging latches are provided between the base and the cover to hold the base and cover together clamping the cable in the cable-receiving passage. A plurality of insulation displacement terminals are movably mounted in the terminal-receiving passages for movement between inactive positions out of engagement with the conductors of the cable and insulation-displacement positions piercing the insulation of the cable and electrically terminating the conductors.

9 Claims, 4 Drawing Sheets

ELECTRICAL CONNECTOR WITH CABLE CLAMPING MEANS

FIELD OF THE INVENTION

This invention generally relates to the art of electrical connectors and, particularly, to a connector assembly for clamping an electrical cable during insulation-displacement termination thereof.

BACKGROUND OF THE INVENTION

Electrical connector assemblies are available for multi-conductor flat cables and which include an elongated housing or base having a cable terminating face. The housing mounts a plurality of contacts or terminals having respective conductor-receiving portions extending from the terminating face, such as insulation displacement terminating portions. The connector assembly often includes an elongated cable clamping cover having latch means engageable with complementary latch means on the housing to retain the cover against the cable terminating face of the housing. Either the cover, or the cover in combination with the housing, includes a cable-receiving passage for receiving the multi-conductor flat cable. The passage traverses the terminals which terminate the conductors. Such connector assemblies are used, for example, in a communication system wherein it may be desirable to tap a peripheral device into the cable of an existing system.

One of the problems occurring with electrical connector assemblies of the character described above, is the lack of precise positioning of the cable relative to the terminals. This problem is magnified by the ever-increasing miniaturization of electronic devices and their associated electrical connector assemblies, as well as the multi-conductor cables themselves. For instance, one type of electrical connector assembly of the character described simply includes a housing having terminals rigidly fixed therein, with insulation displacement portions of the terminals projecting from the cable terminating face of the housing. The cover then is used to drive the cable toward the housing, thereby driving the conductors of the cable into the projecting insulation displacement portions of the terminals. With this type of connector assembly, there simply is inadequate precise positioning of the cable relative to the terminals in contemporary miniaturized circuitry.

An improved connector assembly is shown in U.S. Pat. No. 5,171,163, dated Dec. 15, 1992 and assigned to assignee of the present invention. In that patent, the cover has two parts hinged together to provide a clamping device for the cable. The clamped cable then is driven, by means of the cover, into insulation displacement termination with the terminals mounted in the housing. Although improved cable clamping is afforded by this type of connector assembly, and the assembly is an improvement over the prior art at that time, the cable still is driven into the terminals, lacking the precision required with some miniaturized electronics.

Still another approach to solving these problems is in an electrical connector assembly wherein the movable covers are eliminated, and the terminals, themselves, are moved into insulation displacement termination with the conductors of the cable. More particularly, a one-piece housing includes a slot into which the multi-conductor flat cable is inserted. Terminals are preloaded into the housing and are moved into insulation displacement positions piercing the insulation of the cable and terminating the conductors after the cable is inserted into the slot. Unfortunately, even this type of connector assembly does not provide precise positioning of the cable, itself, relative to the movable terminals.

The present invention is directed to solving this myriad of problems and conflicting structural approaches by providing an electrical connector assembly of the character described wherein both a cover and the terminals are movable relative to the housing, with the cover precisely clamping the cable, and then the terminals are moved into insulation displacement positions terminating the conductors of the cable.

SUMMARY OF THE INVENTION

An object, therefore, of the invention is to provide a new and improved insulation displacement electrical connector assembly for electrically terminating the conductors of an electrical cable, such as a multi-conductor insulated flat cable.

In the exemplary embodiment of the invention, the connector assembly includes a housing or base having a plurality of terminal-receiving passages. A cover is positionable on the base for providing a cable-receiving passage therebetween. The cable-receiving passage traverses the terminal-receiving passages. Complementary interengaging latch means are provided between the base and the cover to hold the base and cover together clamping the cable in the cable-receiving passage. With the base and cover held together with the cable therebetween the cable is gripped to relieve strain being placed on the terminals. A plurality of insulation displacement terminals are movably mounted in the terminal-receiving passages for movement between inactive positions out of engagement with the conductors of the cable and insulation-displacement positions piercing the insulation of the cable and electrically terminating the conductors.

This configuration not only helps to locate the cable but is also helps to grip the cable. This configuration not only helps to locate the calbe but it also helps to grip the cable.

As disclosed herein, the base and the cover have opposing faces defining the cable-receiving passage. At least one of the faces has at least an undulated portion matching an undulated cross-sectional configuration of the multi-conductor flat cable.

Each terminal is bifurcated to define a pair of insulation displacement arms with a conductor-receiving slot therebetween. Complementary interengaging cam means are provided between the cover and the insulation displacement arms to drive the arms inwardly toward each other against the conductor in response to movement of the respective terminal from its inactive position to its insulation-displacement position.

Another feature of the invention is to provide the interengaging latch means with detent means for holding the cover on the base in a preloading position allowing free loading of the cable into the cable-receiving passage prior to moving the cover to a clamping position clamping the cable in the passage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
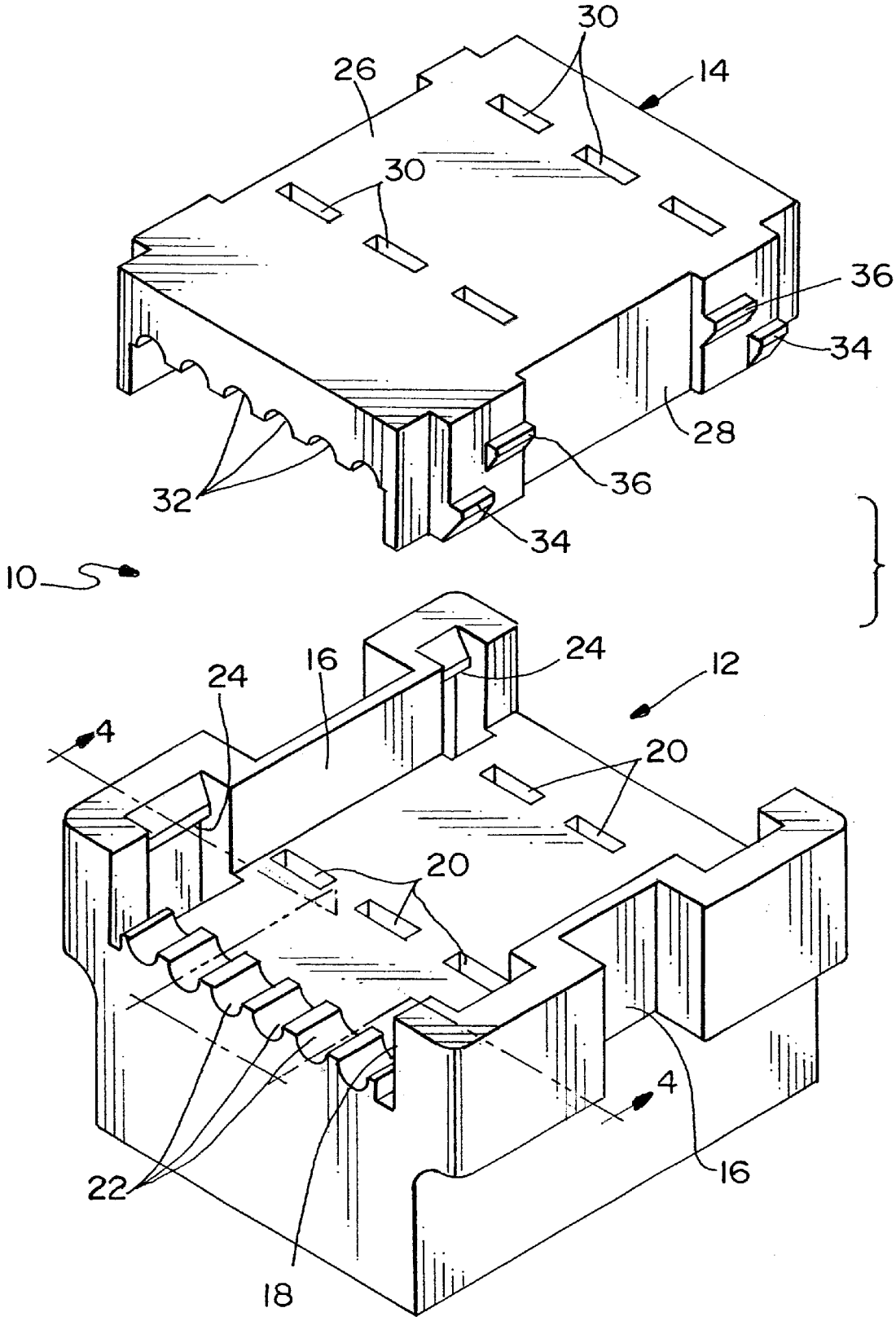
FIG. 1 is a perspective view of an electrical connector assembly incorporating the concepts of the invention, with the cover removed from the housing or base.

Referring to the drawings in greater detail, and first to FIG. 1, the invention is embodied in an insulation displacement electrical connector assembly, generally designated 10, which is designed for electrically terminating the conductors of a multi-conductor insulated flat cable, as described in detail hereinafter. Generally, connector assembly 10 is a two-part assembly including a housing or base, generally designated 12, and a cover, generally designated 14. Each of the base and the cover is unitarily molded of dielectric material such as plastic or the like.

Connector housing or base 12 includes a pair of upstanding side walls 16 defining a cover-receiving recess 18 therebetween. The base has a plurality of terminal-receiving passages 20, the passages extending in a vertical direction as viewed in FIG. 1. An upwardly facing front portion of recess 18 is undulated, as at 22, across the housing to provide one-half of an undulated configuration matching the undulated cross-sectional configuration of the multi-conductor flat cable described hereinafter. Lastly, four latch shoulders 24 face downwardly and inwardly at the four corners of the base, within recess 18, for latching with appropriate complementary latch means on cover 14, as described below.

Cover 14 has a top wall 26 and a pair of side walls 28. Top wall 26 has a plurality of passages 30 alignable with terminal-receiving passages 20 in base 12. Passages 30 in cover 14 are provided for movably receiving the insulation displacement portions of the terminals, again as described hereinafter. A front portion of the cover is undulated, as at 32, to match the undulated configuration 22 of base 12 for sandwiching the multi-conductor flat cable therebetween. Lastly, each of the four corners of cover 14, on the outside of side walls 28, is provided with two chamfered latch bosses 34 and 36. Each pair of bosses 34 and 36 provide for two-positional mounting of cover 14 on base 12, with the latch bosses cooperating with interior latch shoulders 24 of base 12.

Figure 2:
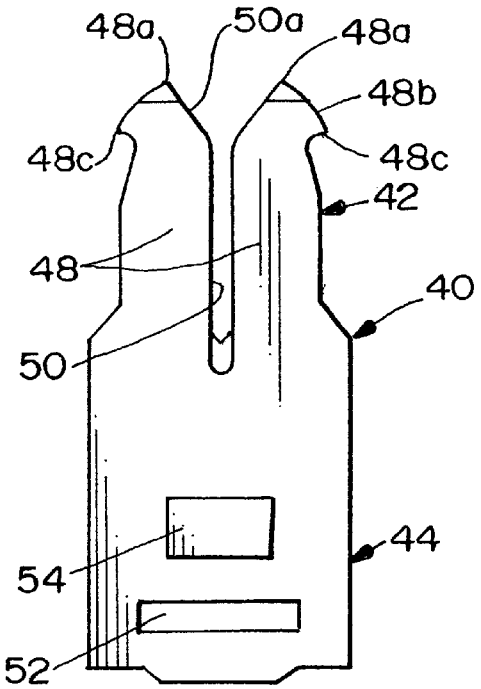
FIG. 2 is a side elevational view of one of the terminals.
Figure 3:
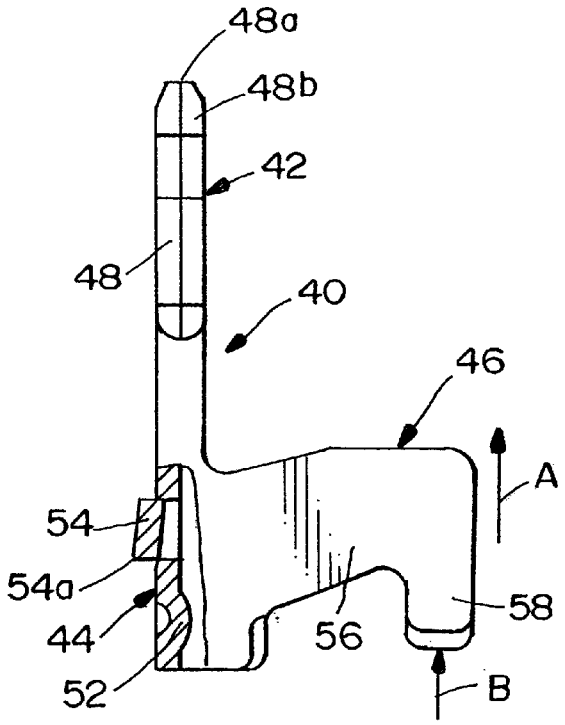
FIG. 3 is a fragmented elevational view of the terminal perpendicular to the view of FIG. 2.

FIGS. 2 and 3 show one of a plurality of terminals, generally designated 40, mounted in each of the terminal-receiving passages 20 of base 12. Each terminal has a terminating portion, generally designated 42, a retaining portion, generally designated 44, and a driving portion, generally designated 46.

Terminating portion 42 of each terminal 40 is bifurcated to define a pair of insulation displacement arms 48 with a conductor-receiving slot 50 therebetween. The tips of the arms are pointed, as at 48*a*, and the slot has an outwardly widening mouth, as at 50*a*. The arms have outside camming surfaces 48*b*, near pointed tips 48*a* and side tips 48*c*. When the terminal is driven into the insulated multi-conductor flat cable, pointed ends 48*a* of arms 48 pierce the webbing between the conductors of the cable, as one of the conductors is guided by mouth 50*a* into slot 50 which further pierces the insulation and establishes a mechanical and electrical termination with one of the conductors. The side tips 48*c* will slide over terminal passage walls 30 as the insulation displacement arms 48 and cover 14 move toward each other. The arms 48 are prevented from moving out of engagement with the cover by side tips 48*c* skiving into the terminal passage walls 30 of cover 14.

Retaining portion 44 of each terminal 40 includes a press-fit dimple 52 and a stamped and formed retention tooth 54. The retention tooth is angled slightly outwardly and downwardly to allow the terminal to be driven upwardly in the direction of arrow "A" (FIG. 3) whereupon a lower sharp edge 54*a* of the tooth will prevent the terminal from backing out of its passage as the tooth digs into the plastic material of the housing.

Driving portion 46 of each terminal 40 includes a rigid planar section 56 terminating in an outer, downwardly projecting leg 58. The terminal is driven from an inactive position (described hereinafter) to an insulation-displacement position (described hereinafter) in the direction of arrow "A" by an appropriate insertion tool engaging leg 58, as at arrow "B".

Figure 4:
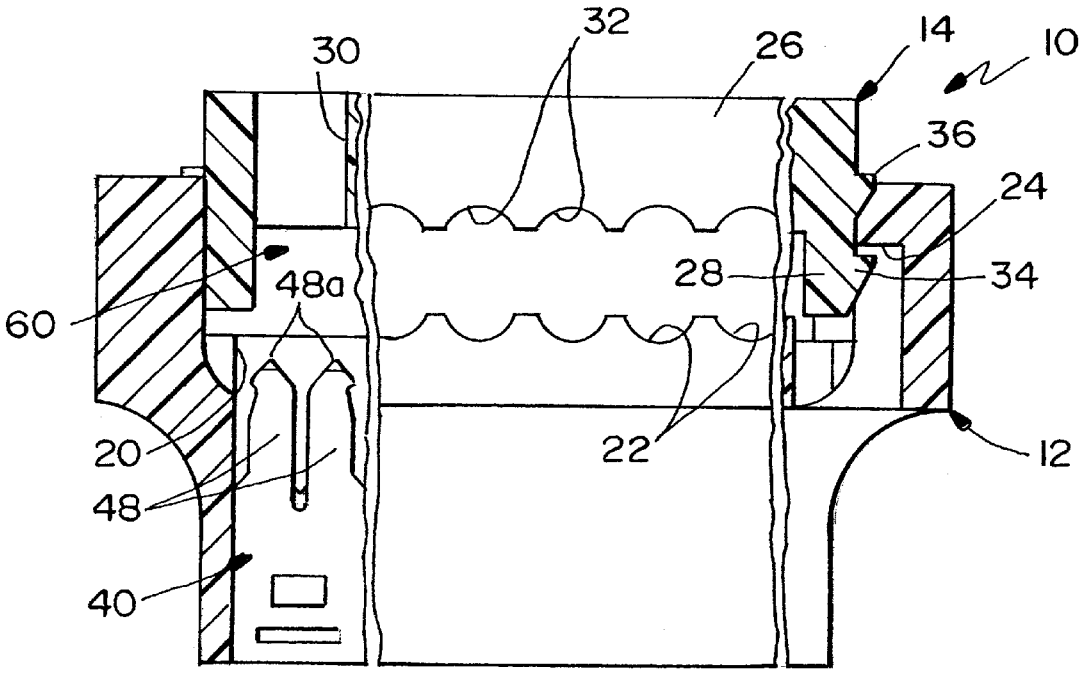
FIG. 4 is a vertical section through the connector assembly, with the cover in its preloaded position prior to receiving the flat cable and with one of the terminals in its inactive position.

FIG. 4 shows cover 14 in a preloaded position relative to base 12 to define a cable-receiving passage, generally designated 60, between the cover and the base. This preloaded position is defined by latch bosses 34 of cover 14 snapping behind latch shoulders 24 of cover 12. In the preloaded position of the cover, cable-receiving passage 60 is wide enough to allow for free insertion of the multi-conductor cable thereinto. It can be seen that in the preloaded position of the cover, terminals 40 are in lower inactive positions such that pointed tips 48*a* of insulation displacement arms 48 of the terminals do not project upwardly into cable-receiving passage 60.

Figure 5:
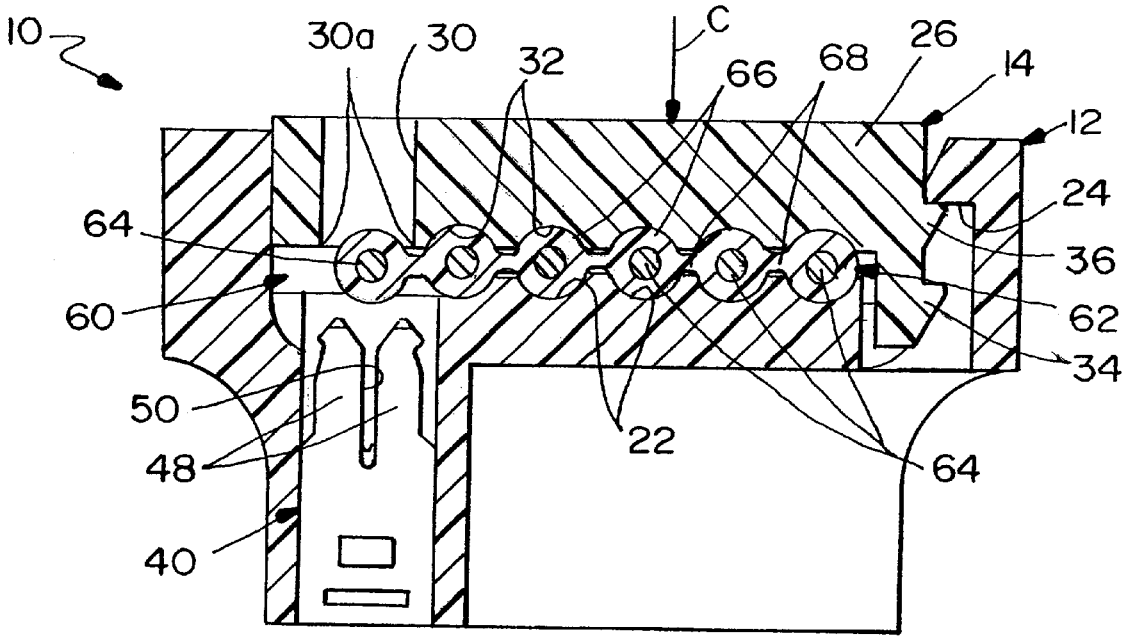
FIG. 5 is a view similar to that of FIG. 4, but showing the cover in its clamping position.

FIG. 5 shows a multi-conductor insulated flat cable, generally designated 62, inserted in cable-receiving passage 60 between cover 14 and base 12, with the cover now having been moved downwardly in the direction of arrow "C" to a cable clamping position. This position is defined by latch bosses 36 of the cover snapping behind latch shoulders 24 of the base. The multi-conductor cable has a plurality of conductors 64 respectively aligned with the undulations 22 of the base and the matching, aligned undulations 32 of the cover. Therefore, not only is the multi-conductor flat cable clamped between the cover and the base, but the conductors are precisely aligned with the terminals, as seen by the left-hand terminal shown in FIG. 5. Specifically, the left-hand conductor 64 is precisely aligned with insulation displacement slot 50 between arms 48 of the left-hand terminal. It can be seen that conductors 64 are surrounded by insulating material 66 which seat into undulations 22 and 32, as well as insulating material defining webs 68 between the terminals.

Figure 6:
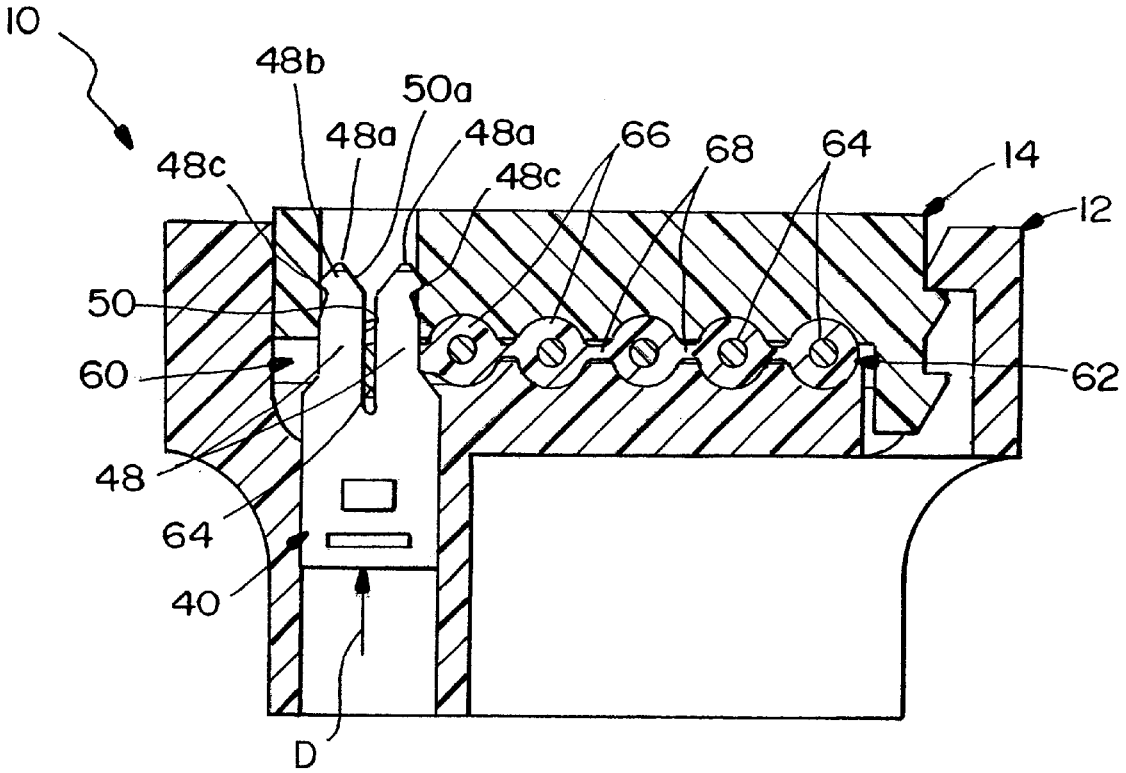
FIG. 6 is a view similar to that of FIG. 5, but showing the terminal in its insulation-displacement position.
Figure 7:
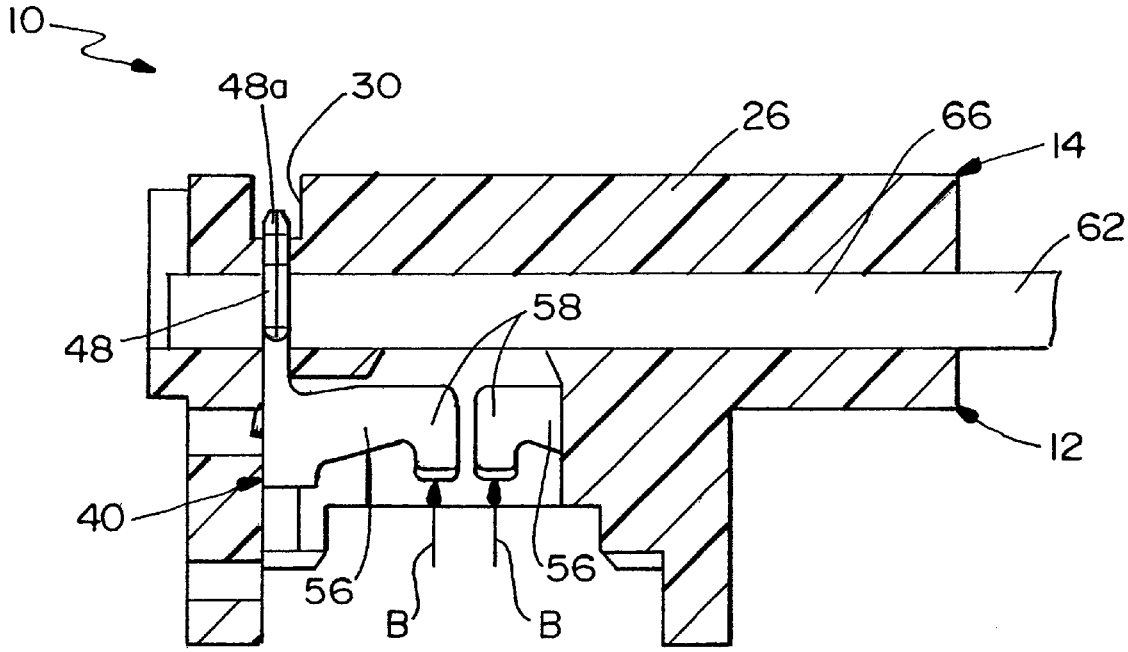
FIG. 7 is a section taken generally along line 7—7 of FIG. 6.

FIGS. 6 and 7 show the last step in terminating multi-conductor cable 62, wherein terminals 40 have been driven, either individually or simultaneously, upwardly in the direction of arrow "D". When each terminal is driven upwardly, pointed ends 48*a* of insulation displacement arms 48 pierce through the insulating webs 68 of the cable. Conductors 64 of the cable are guided by mouths 50*a* of the terminals into slots 50 which further cut through insulation 66 until arms 48 establish mechanical and electrical connection with the conductors. During movement of terminals 40 upwardly from their inactive positions to their insulation-displacement positions, outside camming surfaces 49*b* of insulation displacement arms 48 engage the lower corners or edges 30*a* (FIG. 5) of each passage 30 in cover 14 and drive the arms inwardly toward each other against the respective conductor. In other words, the arms are driven inwardly automatically in response to movement of the terminal from its inactive position to its insulation-displacement position. Once the upward movement of the terminals into cover 14 stops, side tips 48*c* skive into the cover terminal passage walls 30 preventing disengagement between the terminals and cover.

FIG. 7 shows how legs 58 of driving portions 56 of the terminals are exposed on the underside of base or housing 12 for access by an insertion tool which can drive the terminals to their insulation displacement positions either individually or simultaneously by a "gang" terminating operation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for electrically terminating the conductors of a multi-conductor insulated cable, comprising:

a connector housing base having a plurality of terminal-receiving passages;

a connector housing cover positionable on the base to provide a cable-receiving passage therebetween, the cable-receiving passage traversing said terminal-receiving passages;

complementary interengaging latch means between the base and the cover to hold the base and cover together, after moving the base and cover toward each other, clamping the cable in the cable-receiving passage; and a plurality of terminals movably mounted in the terminal-receiving passages for movement, independent from the movement of the base and cover toward each other, between inactive positions out of engagement with the conductors of the cable and engaging positions electrically engaging the conductors of the cable.

2. The electrical connector of claim 1 wherein said base and said cover have opposing faces defining the cable-receiving passage, and at least one of the faces has at least an undulated portion matching an undulated cross-sectional configuration of the multi-conductor flat cable.

3. The electrical connector of claim 1, including complementary interengaging detent means between the base and the cover for holding the cover on the base in a preloading position allowing free loading of the cable into the cable-receiving passage.

4. The electrical connector of claim 1 wherein said complementary interengaging latch means include means for holding the cover in a first, preloading position allowing free loading of the cable into the cable-receiving passage and a second, clamping position clamping the cable in the passage.

5. The electrical connector of claim 1 wherein said terminals have insulation displacement portions which pierce the insulation of the cable when the terminals are moved into the engaging positions.

6. The electrical connector of claim 5 wherein each of said terminals is bifurcated to define a pair of insulation displacement arms with a conductor-receiving slot therebetween.

7. The electrical connector of claim 6, including complementary interengaging cam means between the cover and the insulation displacement arms to drive the arms inwardly toward each other against the conductor in response to movement of the respective terminal from its inactive position to its engaging position.

8. An insulation displacement electrical connector assembly for electrically terminating the conductors of a multi-conductor insulated cable, comprising:

a connector housing base having a plurality of terminal-receiving passages;

a connector housing cover positionable on the base to provide a cable-receiving passage therebetween, the cable-receiving passage traversing said terminal-receiving passages;

complementary interengaging latch means between the base and the cover for holding the cover in a first, preloading position allowing free loading of the cable into the cable-receiving passage and a second, clamping position, after moving the base and cover toward each other, cooperating with the base to clamp the cable in the passage;

a plurality of insulation displacement terminals movably mounted in the terminal-receiving passages for movement, independent from the movement of the base and cover toward each other, between inactive positions out of engagement with the conductors of the cable and insulation-displacement positions piercing the insulation of the cable and electrically terminating the conductors, each of said terminals being bifurcated to define a pair of insulation displacement arms with a conductor-receiving slot therebetween; and complementary interengaging cam means between the cover and the insulation displacement arms to drive the arms inwardly toward each other against the conductors in response to movement of the terminals from their inactive position to their insulation-displacement position.

9. The insulation displacement electrical connector of claim 8 wherein said base and said cover have opposing faces defining the cable-receiving passage, and at least one of the faces has at least an undulated portion matching an undulated cross-sectional configuration of the multi-conductor flat cable.

* * * * *